United States Patent [19]

Hendrischk

[11] 4,395,152

[45] Jul. 26, 1983

[54] DRIVE FOR FRICTION ROLLS IN PRINTERS

[75] Inventor: Wolfgang Hendrischk, Neu-Ulm, Fed. Rep. of Germany

[73] Assignee: Mannesmann Aktiengesellschaft, Düsseldorf, Fed. Rep. of Germany

[21] Appl. No.: 253,408

[22] Filed: Apr. 13, 1981

[30] Foreign Application Priority Data

Apr. 14, 1980 [DE] Fed. Rep. of Germany ..... 3014609

[51] Int. Cl.[3] ..... B41J 11/50; B41J 19/78

[52] U.S. Cl. ..... 400/569; 400/585; 400/588

[58] Field of Search ..... 400/585, 588, 569, 567, 400/568

[56] References Cited

U.S. PATENT DOCUMENTS

| | | | |
|---|---|---|---|
| 1,362,338 | 12/1920 | Messenger | 400/569 X |
| 1,451,293 | 4/1923 | Doody | 400/585 |
| 1,539,384 | 5/1925 | Coo | 400/585 |
| 1,604,645 | 10/1926 | Kurowski | 400/585 |
| 1,705,946 | 3/1929 | Smith | 400/585 X |
| 1,737,723 | 12/1929 | Kurowski et al. | 400/585 |
| 4,204,779 | 5/1980 | Lee et al. | 400/585 X |

FOREIGN PATENT DOCUMENTS

| | | | |
|---|---|---|---|
| 135598 | 5/1979 | Fed. Rep. of Germany | 400/585 |

*Primary Examiner*—Edgar S. Burr
*Assistant Examiner*—Moshe I. Cohen
*Attorney, Agent, or Firm*—Ralf H. Siegemund

[57] ABSTRACT

Two friction rolls are journalled on a driven shaft, and a differential being keyed to that shaft causes that one of the rolls to be driven which is not held. The rolls are alternately held by, preferably, latching devices which are operated on limit positions of the print head.

8 Claims, 3 Drawing Figures

DRIVE FOR FRICTION ROLLS IN PRINTERS

BACKGROUND OF THE INVENTION

The present invention relates to a friction drive for printers having at least two friction rolls which are mounted for independent rotation on a common shaft.

U.S. Ser. No. 871,459, filed Jan. 18, 1978, (see also German printed patent application No. 27 03 345) discloses a friction advance for individual sheets, wherein particularly each roll is a hollow element containing an electromagnetic coupling structure for coupling the roll to the common shaft. Each roll contains also an electromagnetically operated brake. This way, the rolls can be driven and stopped independently from each other.

This friction drive principle for two or more of the rolls has been employed quite successfully. There is, however, a need for a simplified version, in particular for those cases in which only one or the other of two rolls are to be driven, but never both together.

DESCRIPTION OF THE INVENTION

It is an object of the present invention to provide a new and improved drive for two friction rolls in a printer; particularly for the case that only one roll at a time is to be driven.

It is another object of the present invention to provide such a drive for two rolls which does not require individual operating and control signals to be generated in the printer.

In accordance with the preferred embodiment of the present invention, it is suggested to provide a common shaft for two of such rolls with a differential which revolves with the shaft and has two revolving planet gears meshing with each other and respectively with internal ring gears in the rolls. In addition, external holding means are provided to selectively hold one or the other of the rolls so that, thereby, the respective roll which is not being held is driven by the differential. The holding means includes preferably interlinked latching or locking levers which are operated by the print head as the print head will operate only within the range of one roll or the other so that this difference in positions can be used to directly control the holding mechanism for the rolls. This way, holding one roll and the effective drive-coupling of the respective other roll is the direct result of a mechanical operation and does not require additional electrical control signals.

The preferred embodiment of the invention, the objects and features of the invention, and further objects, features and advantages thereof, will be better understood from the following description taken in connection with the accompanying drawings.

DESCRIPTION OF THE DRAWINGS

Proceeding now to the detailed description of the drawings, FIG. 1 illustrates two hollow friction rolls 1 and 2 journalled on a rotating shaft 3 by means of bearings 15 and 16. A locking and holding mechanism 4 serves to hold roll 2 and to prevent its rotation. A differential 5 connects one or the other of the rolls to shaft 3, provided the respective other roll is held.

Figure 3:
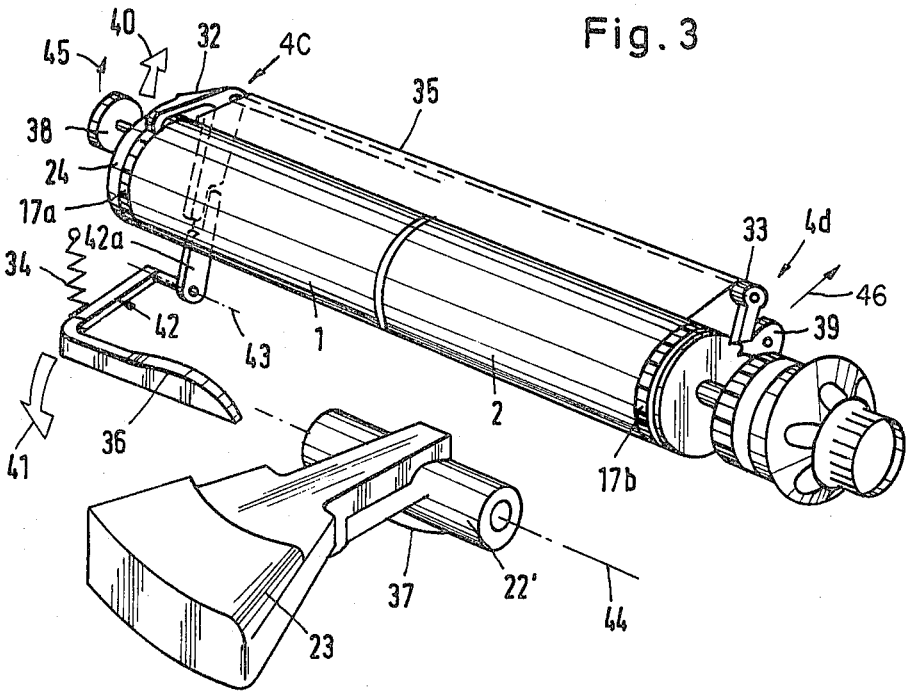
FIG. 3 is a perspective view of such a portion of a printer, but showing a modified actuating mechanism.

The differential 5 includes a cage 6, being comprised of a pair of parallely disposed disks 6*a* and 6*b*, joined by a hub or sleeve structure 6*c*. By means of a splice or key 6*d* cage 6 is secured to shaft 3 for rotating therewith. Pins such as 7*a* and 8*a* extend toward each other from disks 6*a* and 6*b* respectively, and the cylindrical planet gears 7 and 8 are journalled on these pins.

Planet gears 7 mesh with the teeth of an internal ring gear 10 of roll 1, and planet gears 8 mesh with an internal gear 9 of roll 2. The inside wall-to-wall spacing between disks 6*a* and 6*b* is larger than the largest spacing dimension between internal ring gears 9 and 10. The gears 7 and 8 overlap so as to mesh with each other.

The holding device 4 includes a two-arm lever 13 which is pivotably mounted on a pin which, in turn, projects from case 50 of the printer. An actuator, such as solenoid 14, is linked to one arm of lever 13 in order to pivot the lever into one or the other of two limit positions. The other arm of lever 13 when in the illustrated position, locks the roll.

For this, a gearing-like teeth arrangement 11 is provided on the front end of roll 2. Roll 1 has a similar teeth arrangement 12, and that other arm of lever 13 can lock roll 1 in the other limit position of the lever. It can, thus, be seen that one or the other of the two rolls is always held against rotation.

It should be noted that it is not essential to provide these locking teeth arrangements 11 and 12 at facing axial front ends of the two rolls. Moreover, other holding structures can be employed. The illustrated structures demonstrate only examples of the basic features of the invention in that one figure.

In operation, shaft 3 rotates, continuously or in steps, and cage 6 follows that rotation. It is assumed that lever 13 has the illustrated position and holds roll 2. Thus, gear 9 is held so that planet gear 7 is caused to rotate about pin 7*a* as the pin revolves about the common axis of shaft 3 and cage 6. Pin 8*a* does likewise follow that rotation of the shaft, but gear 8 meshes with gear 7 and is, therefore, driven independently from the rotation of disk 6*b* and pin 8*a*. The rotation of gear 8 is now transmitted to gear 10 and roll 1 is driven accordingly. Thus, one plant gear revolves about the internal ring gear of the sleeve being held so that the other planet gear can set the other ring gear into a turning motion; the respective roll is driven thereby.

If roll 2 is to be driven, actuator 14 will change the position of locking lever 13; and that lever, thus, holds roll 1 but releases roll 2. Now, gear 10 stops and gear 8 revolves about it while driving gear 7, causing gear 9 to be driven, and roll 2 will now rotate.

Figure 1:
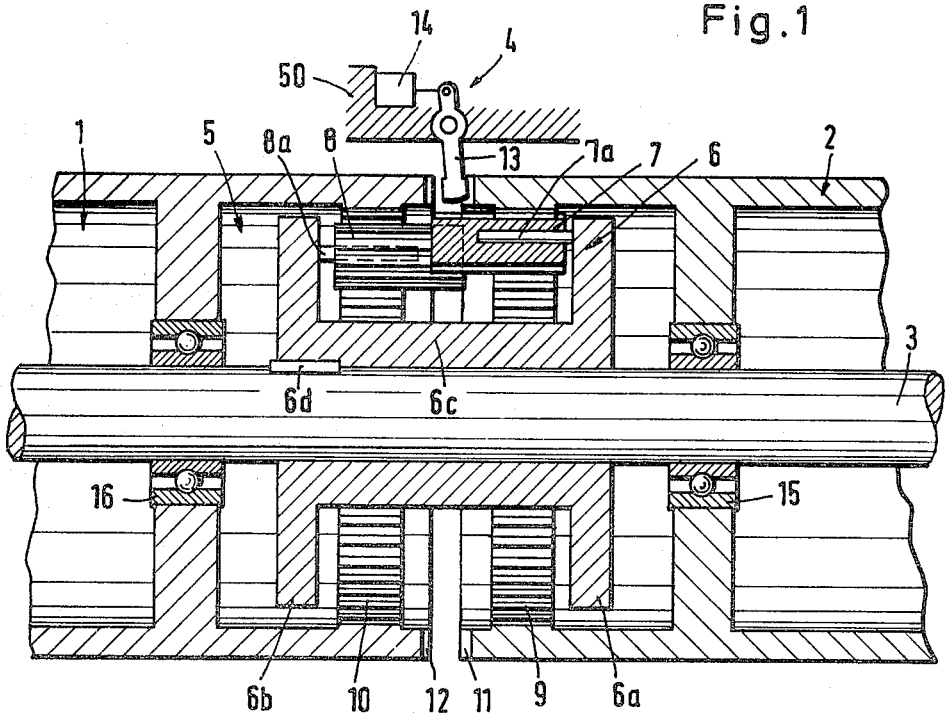
FIG. 1 is a section through portions of two juxtaposed friction rolls for a printer, showing also a differential coupling structure for interconnecting these rolls in accordance with the present invention.
Figure 2:
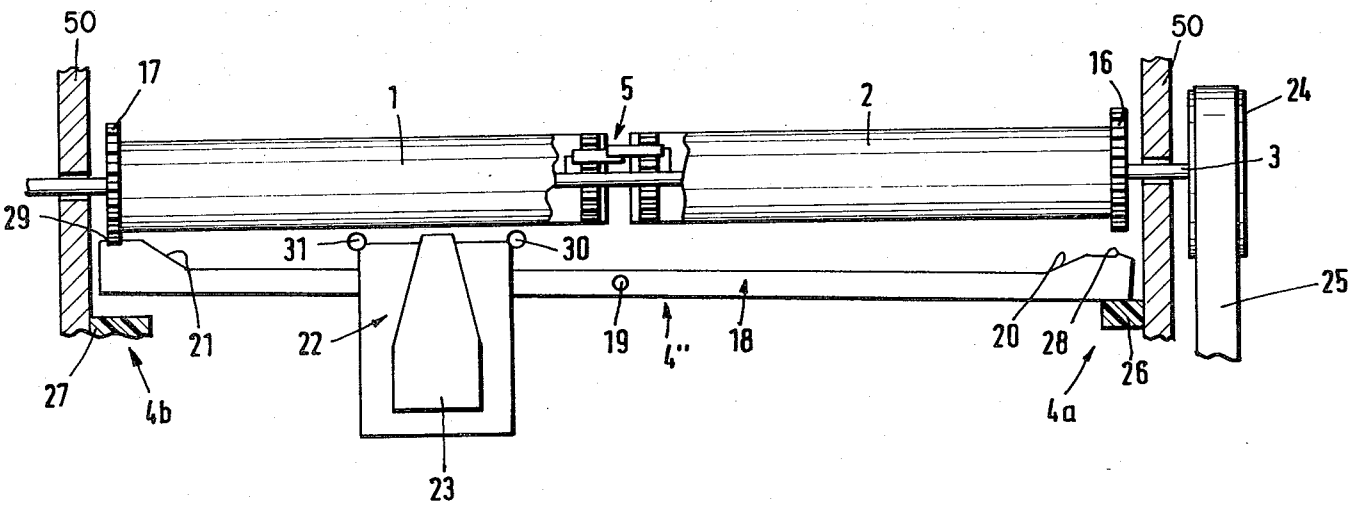
FIG. 2 shows a portion of such a printer, incorporating the structure shown in FIG. 1, but also showing a different actuating mechanism.

The same principle of operation ensues in the arrangement in FIG. 2, being actually one example of the preferred embodiment. The construction shown in that figure differs from FIG. 1 in respect to the locking mechanism, denoted here as 4''. The locking device and mechanism includes a rocking lever 18, being pivotably mounted on a central pin 19 in printer housing 50. The rocking lever 18 is disposed underneath a print head 23. The print head 23 is mounted on a carriage 22, and pins 30 and 31 are secured to that carriage, moving therewith and serving as actuators. The end portions of lever 18 are constructed as cam surfaces 20 and 21, respectively, pertaining to locking structures 4*a* and 4*b*. This particular example operates without any electrical, external control signal for a switchover from one roll to the other. The switchover is controlled through the head carriage in that the position of that carriage triggers specific mechanical operations in these locking structures 4a and 4b.

The outer ends of rolls 1 and 2 are provided with lock-type gearings 17a and 17b, respectively. A locking nose 29 is shown to engage gearing 17. That nose is situated next to cam surface 21. The other end of lever 18 is provided with a locking nose 28, presently being disengaged from gearing 17b. Pins 30 and 31 are disposed to engage cam surfaces 20 and 21, provided the nose (28 or 29) at the respective cam surface engages the respective gear (17b or 17a).

Presently, it is assumed that carriage 22 moves to the left. Roll 1 is still held and roll 2 rotates in the same manner that was described above. Soon, pin 31 on carriage 22 will run onto cam surface 21 and pull nose 29 out of locking gear 17a. This affects lever 18 as a whole and, shortly thereafter, nose 28 will enter gear 17b and stop roll 2. Roll 1 is now the driven one and will continue to rotate as long as carriage 22 moves just in front of platen roll 1, or at least, it will not cause pin 30 to hit cam surface 20. When that occurs, the driving condition reverts to the illustrated state.

It can, thus, be seen that the locking operation is controlled here strictly mechanically by lever means operated by the print head carriage because that print head will operate next to one paper feed roll or the other. Only upon change-over will the print head be caused to move toward the end of the yet to be halted roll in order to unlock it.

Reference numerals 26 and 27 refer to the permanent magnets, one of which at a time conveniently holds the lever 18 in the established position until the force of the carriage drive causes (via pin 30 or 31) lever 18 to be pulled off its respective engaging position with one of the magnets. This, of course, is but a single example for ensuring that lever 18 retains its position as long as a pin (30 or 31) does not cause the lever to swivel into the opposite position.

FIG. 2 shows also a gear 24 for driving the common shaft 3; this gear is being driven by a toothed belt which, in turn, is driven by a suitable motor.

Another version of the locking and holding mechanism is shown in FIG. 3. This figure shows a print head carriage 22' for movement on and along an axis 44. The linking mechanism is divided into two separate portions, portion 4c for roll 1 and portion 4d for roll 2. Again, peripheral gearing for locking is provided at the outer ends of the rolls: gearing 17a for roll 1, gearing 17b for roll 2. Gearings 17b and 17a are associated with ratchet levers 32 and 33, respectively, and these levers are mounted to a rocker 35. Only one at a time latches the respective gearing.

Each one of the levers 32 and 33 has an extension, one being shown for lever 32; it is held, in this instance, by an upright portion of a complex lever 42. This lever is biased by a spring 34 so that the upright arm 42a holds lever 32 in the locking position. Lever 42 has a cam arm extension 36 which will engage a cam actuator 37 on carriage 22' for the print head 23 as soon as that head and carriage approach a left-hand limit position. Now, arm 42 is pivoted, as indicated by arrow 41, to release lever 32 and to also pivot rocker 35 so that lever 33 engages gear 16. As long as the carriage 22' now moves only in a left-hand range, nothing will change because lever 32 is, in effect, retained in the unlocked position by the spring in the companion device cooperating with lever 33. Please note that even repeated actuation of cam arm 36 by carriage 22' will not affect lever 32 because the generally downward extending portion is pivoted to be out of the range of lever arm 42a. Only after the other lever 33 has been unlocked by the carriage, will locking again be possible by lever 42 in the illustrated position.

Reference numerals 38 and 39 denotes supplemental traction rolls for respectively augmenting paper transport by the respective friction rolls 1 and 2. These traction devices are angularly offset in relation to each other. Arrows 45 and 46 denote the respective paper advance, and arrow 40 represents symbolically a sheet to be printed upon.

The invention is not limited to the embodiments described above; but all changes and modifications thereof, not constituting departures from the spirit and scope of the invention, are intended to be included.

We claim:

1. Friction drive in printers, including a common shaft and first and second juxtaposed friction rolls, journaled on that shaft, the improvement comprising:

a differential having a cage and two meshing planet gears journaled on the cage for revolving about the shaft, the planet gears being in engagement with each other;

first and second gears disposed respectively inside the first and second rolls and respectively meshing the planet gears for driving engagement; and holding means for selectively holding the first roll or the second roll so that the respective other one is driven via the respective planet gear as engaging respectively the first or the second gear pertaining to the roll not being held by the holding means.

2. Friction drive for a printer having a movable print head, the improvement as in claim 1 further comprising means on the head for operating the holding means.

3. Friction drive as in claim 2, the rolls have one end each in juxtaposed disposition, each one of the rolls having respectively an oppositely facing end, the latter ends each being provided with a gearing, lever means for respectively engaging the gearings on the oppositely facing ends, and a common actuator for the lever means to hold the lever means in an engaging position of one or the other of the gearings, for thereby preventing the gearing and the respective roll to which the gearing pertains from rotating.

4. Friction drive as in claim 3, the lever means including two spring-biased levers and actuator means, the actuator means provided for engagement with the print head.

5. Friction drive as in claim 1, the first and second gears being internal ring gears, the differential including a sleeve keyed to said shaft, two end disks each with an axially extending pin, the planet gears being journaled on said pins, the disks being spaced farther apart than the spacing in the axial direction along the shaft between the ring gears.

6. Friction drive as in claim 1, said rolls having facing ends provided with gears, the holding means respectively engaging one or the other of the latter gears for respectively holding the roll to which the gear is engaged by the holding means.

7. Friction drive as in claim 1, said first and second gears being ring gears respectively on the inside of the first and second rolls.

8. Friction drive as in claim 7, the planet gears provided for axially overlapping in an area between said first and second rolls.

* * * * *